US005829295A

United States Patent [19]

Voth et al.

[11] Patent Number: 5,829,295

[45] Date of Patent: Nov. 3, 1998

[54] ROLL FORMING MACHINE FOR FORMING DIFFERENT SIZED COMPONENTS HAVING C- AND Z-SHAPED CROSS SECTIONS

[75] Inventors: Karl E. Voth, Hesston; Philip E. Bradbury, McPherson, both of Kans.

[73] Assignee: The Bradbury Company, Inc., Moundridge, Kans.

[21] Appl. No.: 832,210

[22] Filed: Apr. 8, 1997

[51] Int. Cl.[6] ..... B21D 5/08

[52] U.S. Cl. ..... 72/181; 72/247

[58] Field of Search ..... 72/181, 178, 247, 72/248

[56] References Cited

U.S. PATENT DOCUMENTS

| | | | |
|---|---|---|---|
| 1,125,984 | 1/1915 | Dumas . | |
| 1,669,411 | 5/1928 | Clark . | |
| 1,673,787 | 6/1928 | Frahm | 72/181 |
| 2,102,355 | 12/1937 | Cummins | 80/54 |
| 2,195,398 | 4/1940 | Duda | 64/30 |
| 2,294,324 | 8/1942 | Wikens | 72/181 |
| 2,561,634 | 7/1951 | Picton | 153/54 |
| 2,601,794 | 7/1952 | Wood | 80/55 |
| 2,664,019 | 12/1953 | Henderson | 80/35 |
| 2,774,263 | 12/1956 | Leufven | 80/56 |
| 3,345,849 | 10/1967 | Lowy | 72/249 |
| 3,348,403 | 10/1967 | Bartley | 72/237 |
| 3,452,568 | 7/1969 | Vihl | 72/137 |
| 3,823,592 | 7/1974 | Colbath | 72/181 |
| 4,033,165 | 7/1977 | Arimura et al. | 72/205 |
| 4,237,714 | 12/1980 | Polukhin et al. | 72/242 |
| 4,368,633 | 1/1983 | Nogota | 72/239 |
| 4,557,129 | 12/1985 | Lash et al. | 72/176 |
| 4,716,754 | 1/1988 | Youngs | 72/181 |
| 4,724,695 | 2/1988 | Stoehr | 72/181 |
| 4,787,232 | 11/1988 | Hayes | 72/181 |
| 4,831,857 | 5/1989 | Levy et al. | 72/181 |
| 4,969,347 | 11/1990 | Matsuo et al. | 72/247 |
| 4,974,435 | 12/1990 | Vandenbroucke | 72/176 |
| 5,158,002 | 10/1992 | Matsunaga et al. | 83/479 |
| 5,163,311 | 11/1992 | McClain et al. | 72/181 |
| 5,187,964 | 2/1993 | Levy | 72/181 |
| 5,199,291 | 4/1993 | Bahl, Jr. et al. | 72/181 |

FOREIGN PATENT DOCUMENTS

| | | | |
|---|---|---|---|
| 1 777 039 | 10/1971 | Germany . | |
| 42-4763 | 2/1967 | Japan . | |
| 37833 | 9/1972 | Japan | 72/181 |

*Primary Examiner*—Daniel C. Crane

*Attorney, Agent, or Firm*—Marshall O'Toole, Gerstein, Murray & Borun

[57] ABSTRACT

A roll-forming apparatus of the type used to form components, such as purlins, having C-shaped and/or Z-shaped cross-sections from sheets of planar material is provided with a plurality of roll-forming stations adapted to form first and second components each of which has a C-shaped cross section with a center portion and a pair of legs connected to the center portion, where the legs of the first component have a first length and the legs of the second component have a second length different than the first length. The roll-forming stations include a first roll-forming station having a plurality of forming rolls and a second roll-forming station for forming the legs of the first and second components. The second roll-forming station has a first pair of forming rolls, a second pair of forming rolls, and a mechanism for supporting the pairs of forming rolls and for adjusting the position of the pairs of forming rolls from a first position in which the second pair of forming rolls make contact with a portion of the first component to a second position in which the second pair of forming rolls make contact with a portion of the second component.

24 Claims, 9 Drawing Sheets

30
14a
16a
24a
32
22a
14c
16c
24c
22c
14e
16e
24e
22e
34
36

FIG. 4A
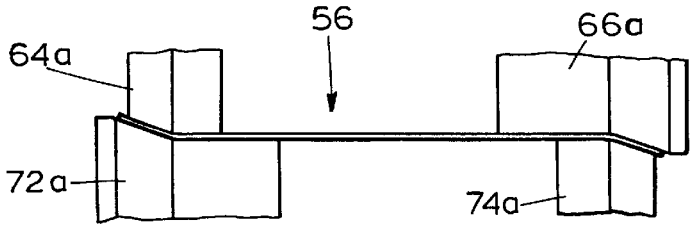
FIG. 4B
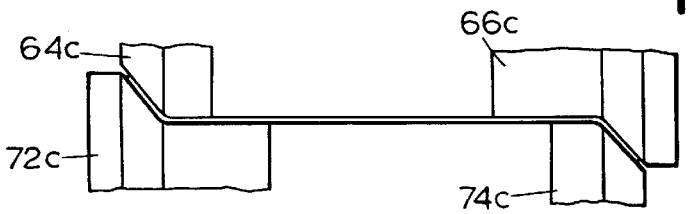
FIG. 4C
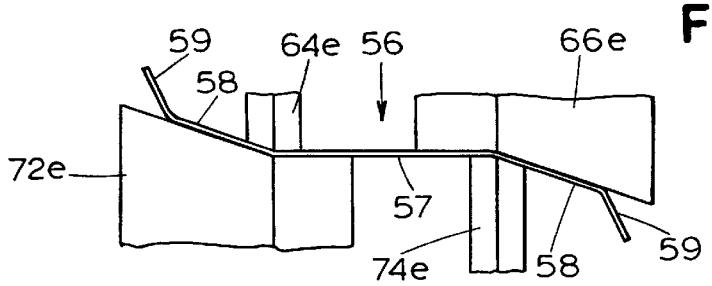
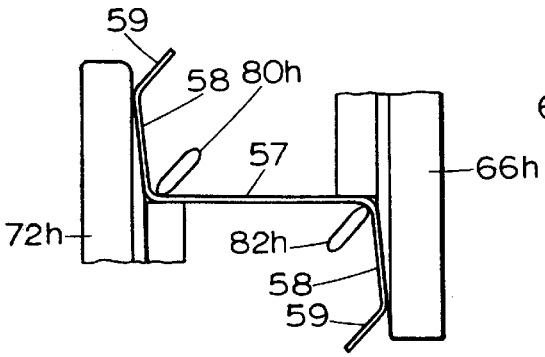
FIG. 4D
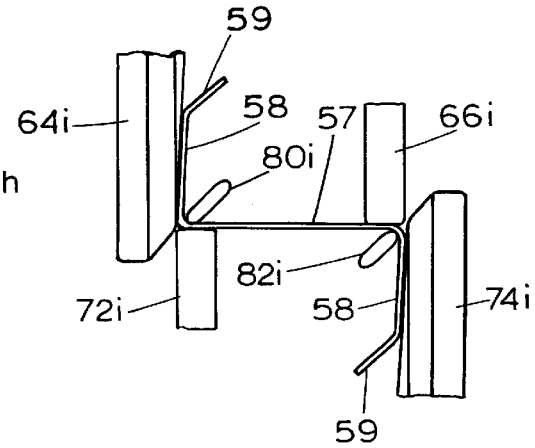
FIG. 4E FIG. 5
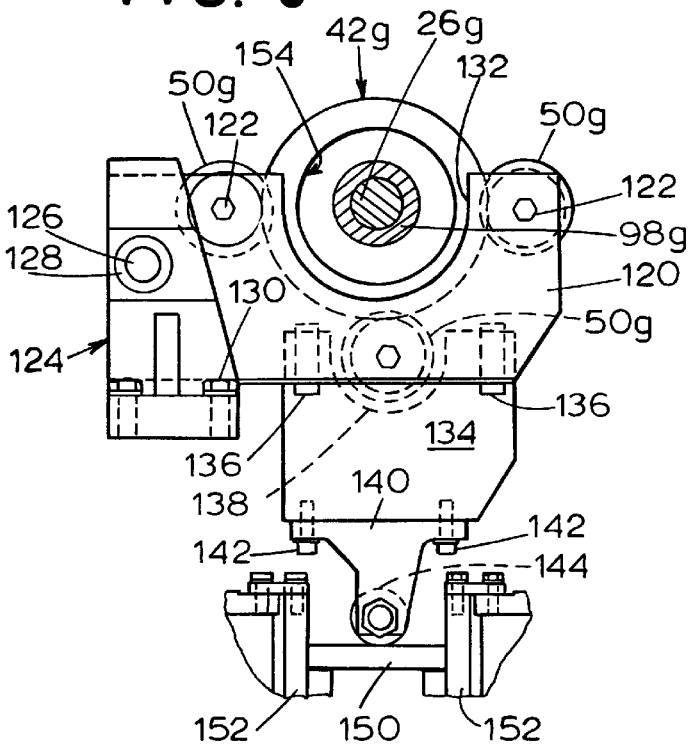
FIG. 6
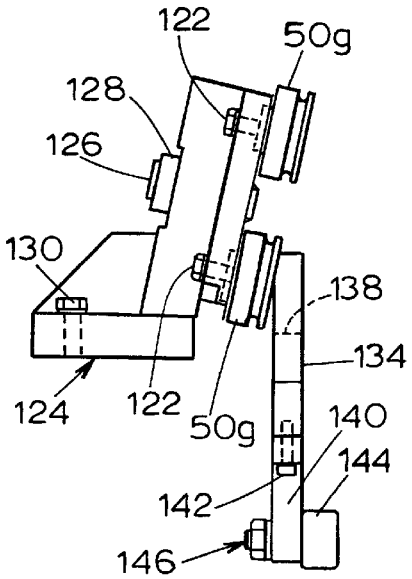
FIG. 7
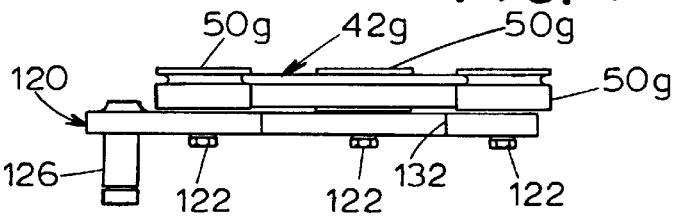
FIG. 8
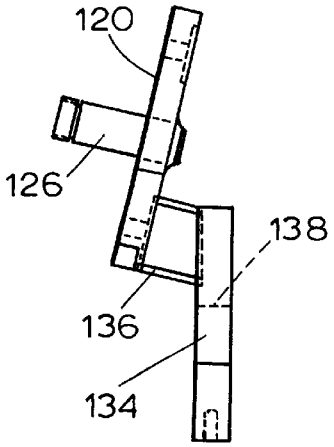
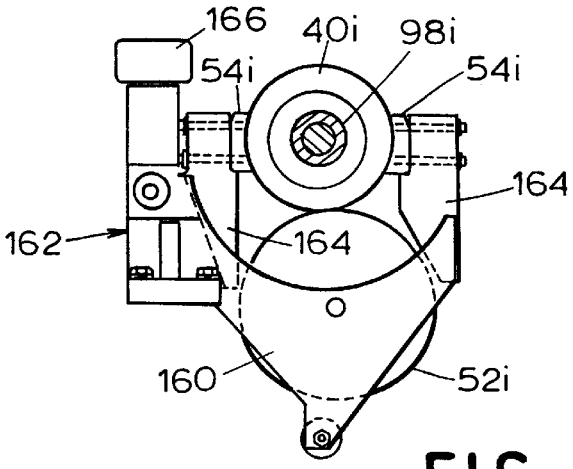
FIG. 9

ROLL FORMING MACHINE FOR FORMING DIFFERENT SIZED COMPONENTS HAVING C- AND Z-SHAPED CROSS SECTIONS

BACKGROUND OF THE INVENTION

The present invention relates to a roll-forming machine of the type which is used to form components, such as purlins, having C-shaped and Z-shaped cross-sections from sheets of planar material.

Roll-forming machines typically include a plurality of roll-forming stations that are used to transform a planar sheet of metal into a component having either a C-shaped or Z-shaped cross-sectional area. The component, such as a C-purlin or Z-purlin, typically has a center portion, a pair of leg portions joined to the center portion by a substantially right angle bend formed by the roll-forming machine, and a flange joined to each leg portion by a respective bend formed by the machine.

Typically, the flanges of a C- or Z-shaped component are made first by a plurality, such as three, roll-forming stations. The first of these stations makes an initial pair of bends at the desired transverse locations on the sheet, and then the successive stations for forming the flanges increase the previously made bends until the flanges are at the proper angle relative to the center portion of the sheet. The legs of the component are then formed by a plurality of roll-forming stations in a similar manner.

Each of the roll-forming stations typically includes a pair of frame members in which a pair of rotatable spindles are journalled, one spindle disposed directly above the other, and a pair of sleeves which cover a portion of the spindles, the sleeves being slidable over the spindles. Each roll-forming station includes at least two pairs of generally cylindrical plates, referred to herein as "forming rolls," two of the forming rolls being fixed to the spindles and the other two forming rolls being fixed to the sleeves. The circumferential ends of the upper and lower forming rolls are vertically spaced apart by a distance corresponding to the thickness of the sheet of material being bent, and the shape or contour of the forming rolls controls the degree to which the sheet is bent. The use of sleeves which are slidable on the spindles and which rotate with the spindles allows the horizontal spacing of the forming rolls on each spindle and sleeve to be varied so that the transverse widths of the center portion and the leg portions of the components being formed can be adjusted.

The sheet of material is forced through the roll-forming machine by friction between the sheet and the rotating forming rolls. The forming rolls of a plurality of the roll-forming stations, e.g. the forming rolls of every other station, are rotatably driven to ensure that there is enough driving power to force the sheet through the machine.

In the case of a C-shaped component, the flanges are made by bending the transverse ends of the sheet in the same direction, for example, downwards, whereas for a Z-shaped component the flanges are made by bending the transverse sheet ends in opposite directions. After the flanges are formed on the transverse ends of the sheet, the legs are formed by a plurality of roll-forming stations by a similar process. To form a component in the above manner, up to ten or more roll-forming stations may be incorporated in the roll-forming machine.

One prior art roll-forming machine incorporates a first set of roll-forming stations adapted to form a Z-shaped component and a second set of roll-forming stations adapted to form a C-shaped component. The two sets of roll-forming stations are driven by a common drive mechanism, connectable to a plurality of roll-forming stations of each set by a pair of coupler mechanisms, so that only one of the sets of roll-forming stations is operable at a time. The forming rolls of both sets of roll-forming stations are horizontally adjustable, as described above, so that the transverse dimensions of the Z- and C-shaped components can be varied.

In the prior art roll-forming machine described above, in order to produce C-shaped components having different transverse dimensions, a pair of forming rolls which were disposed in a number of the roll-forming stations and which were adapted to make flush contact with the flanges of the C-shaped component had to be changed. In particular, where a C-shaped component having a first leg length was to be formed, after the leg portions were substantially formed, the flanges of the component would extend downwards by a distance corresponding to the leg length.

In order to ensure that the forming rolls designed to make flush contact with the flanges made such contact, those forming rolls had to be selected to have a diameter which ensured that the outer cylindrical surfaces of those forming rolls made contact with the flanges of the component. The position of those forming rolls could not be adjusted since they were fixed to a fixed-position spindle and sleeve rotatably journalled in a pair of frame members. Consequently, where C-shaped components having different leg lengths were to be formed, the forming rolls of a number of the roll-forming stations would have to be physically removed and replaced with forming rolls having different diameters.

In the prior art roll-forming machine described above, some of the roll-forming stations used to form Z-shaped components used a pair of angled contact rollers, one of which was disposed to make contact with the Z-shaped component at the inner portion of the bend in the sheet between the center portion and one of the leg portions, and the other of which was disposed to make contact with the Z-shaped component at the inner portion of the bend in the sheet between the center portion and the other leg portion. The position of each of those contact rollers was horizontally adjustable.

SUMMARY OF THE INVENTION

The invention is directed to a roll-forming apparatus of the type which is used to form components, such as purlins, having C-shaped and/or Z-shaped cross-sections from sheets of planar material.

In one aspect, the invention is directed to a roll-forming apparatus having a plurality of roll-forming stations adapted to form first and second components each of which has a C-shaped cross section with a center portion and a pair of legs connected to the center portion, where the legs of the first component have a first length and the legs of the second component have a second length different than the first length.

The roll-forming stations include a first roll-forming station having a plurality of forming rolls and a second roll-forming station for forming the legs of the first and second components. The second roll-forming station has a first pair of forming rolls, a second pair of forming rolls, and means for supporting the pairs of forming rolls and for adjusting the position of the pairs of forming rolls from a first position in which the second pair of forming rolls make contact with a portion of the first component to a second position in which the second pair of forming rolls make contact with a portion of the second component.

The forming rolls of the first and second pairs may be positioned so that the cylindrical surfaces of the forming rolls of the second pair are substantially flush with the flanges of the first component when the forming rolls of the second pair are in the first position and so that the cylindrical surfaces of the forming rolls of the second pair are substantially flush with the flanges of the second component when the forming rolls of the second pair are in the second position.

The means for supporting the forming rolls of the first pair may be a first spindle, the forming rolls of the second pair may have a central aperture through which a second spindle passes, and the means for adjusting the position of the second pair of forming rolls relative to the first pair of forming rolls may be an adjustment mechanism for adjusting the position of the forming rolls of the second pair relative to the second spindle.

The roll-forming apparatus may also include a plurality of roll-forming stations adapted to form components having Z-shaped cross sections with a center portion, a pair of legs connected to the center portion, and a pair of flanges connected to the legs. The apparatus may also include one or more roll-forming stations for forming the flanges of a component having a C- or Z-shaped cross section and one or more roll-forming stations for forming the legs of the components. The roll-forming stations may have a first pair of forming rolls, a second pair of forming rolls, and means for supporting the forming rolls of the first and second pairs and for adjusting the distance between the forming rolls of the first and second pairs so that the legs of two components having different leg lengths may be formed.

The invention is also directed to roll-forming apparatus having a first spindle, a first pair of forming rolls disposed on the first spindle, a second pair of forming rolls each having a central aperture, a second spindle disposed through the central aperture of each of the forming rolls of the second pair, and an adjustment mechanism for adjusting the position of the forming rolls of the second pair relative to the second spindle. The adjustment mechanism may have a cradle mechanism for supporting one of the forming rolls of the second pair, with the cradle mechanism being mechanically uncoupled to that forming roll, and means for adjusting the position of the cradle mechanism.

The invention is also directed to a method of forming first and second C-shaped components having different leg lengths. The method includes the steps of: (a) feeding a sheet of material to a first roll-forming station for causing the flanges of the first component to be formed; (b) feeding the sheet of material to a second roll-forming station for causing the legs of the first component to be formed; (c) feeding the sheet of material to a third roll-forming station having a first pair of forming rolls and a second pair of forming rolls so that the first and second pairs of forming rolls make contact with the first sheet; (d) adjusting the position of the first pair of forming rolls of the third roll-forming station to vary the distance between the first pair of forming rolls and the second pair of forming rolls; (e) feeding a second sheet of material to the first roll-forming station for causing the flanges of the second component to be formed; (f) feeding the second sheet of material to the second roll-forming station for causing the legs of the second component to be formed; and (g) feeding the second sheet of material to the third roll-forming station so that the first and second pairs of forming rolls make contact with the second sheet.

In another aspect, the invention is directed to a roll-forming apparatus adapted to form components each having a Z-shaped cross section with a center portion and a pair of legs connected to the center portion. The apparatus includes at least one forming roll, means for supporting the forming roll, and means for making contact with one of the components at the junction of at least one of the legs of the component and the center portion of the component, the contact means being pivotable about a pivot axis.

The means for making contact may be in the form of a first roller for making contact with the component at a first junction between the center portion and one leg of the component and a second roller for making contact with the component at a second junction between the center portion and the other leg of the component. In addition to being pivotal, the contact means may also be horizontally adjustable.

The features and advantages of the invention will be apparent to those of ordinary skill in the art in view of the detailed description of the preferred embodiment, which is made with reference to the drawings, a brief description of which is provided below.

BRIEF DESCRIPTION OF THE DRAWINGS

FIGS. 4A–4E illustrate portions of a number of roll-forming stations used to form Z-shaped components;

FIGS. 5–8 illustrate a first type of adjustment mechanism for adjusting the vertical position of an annular forming roll;

FIG. 9 illustrates a second type of adjustment mechanism for adjusting the vertical position of an annular forming roll;

DETAILED DESCRIPTION OF A PREFERRED EMBODIMENT

Figure 1A:
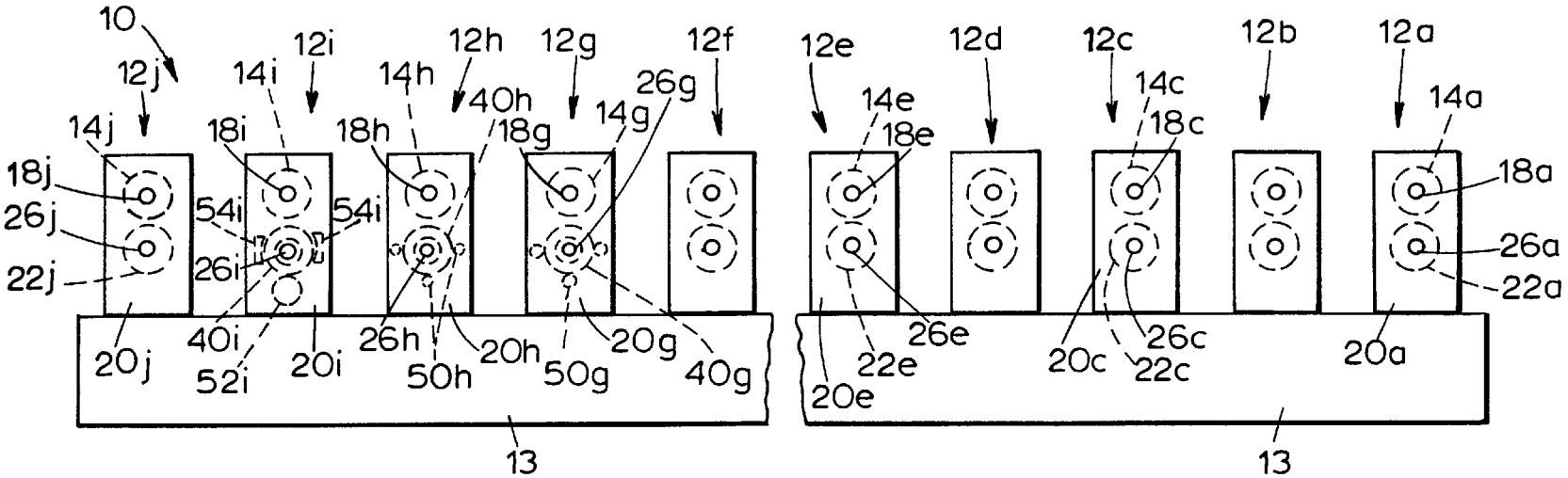
FIG. 1A is a schematic side view of a portion of a preferred embodiment of a roll-forming machine that forms components having C-shaped cross-sections.
Figure 1B:
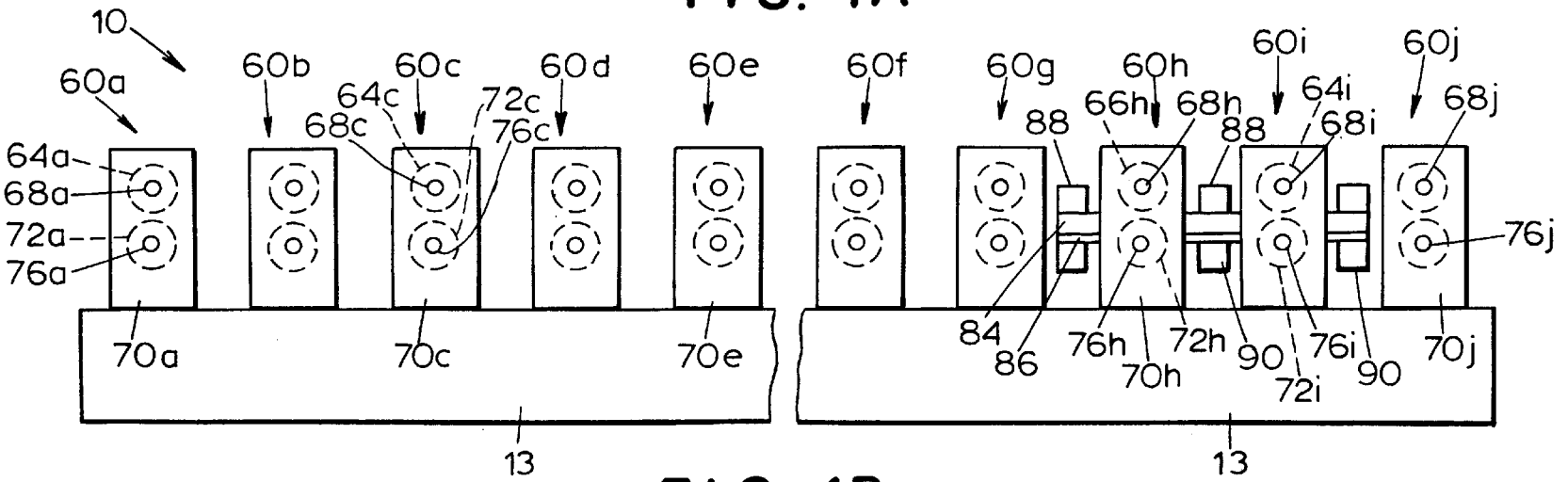
FIG. 1B is a schematic side view of a portion of a preferred embodiment of the roll-forming machine that forms components having Z-shaped cross-sections.

FIGS. 1A and 1B illustrate a schematic side view of a preferred embodiment of a roll-forming machine 10 in accordance with the invention. Referring to FIG. 1A, the roll-forming machine 10 has a plurality of roll-forming stations 12*a*–12*j* supported by a base 13. The roll-forming stations 12*a*–12*j* are used to form a C-shaped component, such as a C-purlin, from a flat sheet of metal at room temperature.

Figures 3A, 3B, 3C:
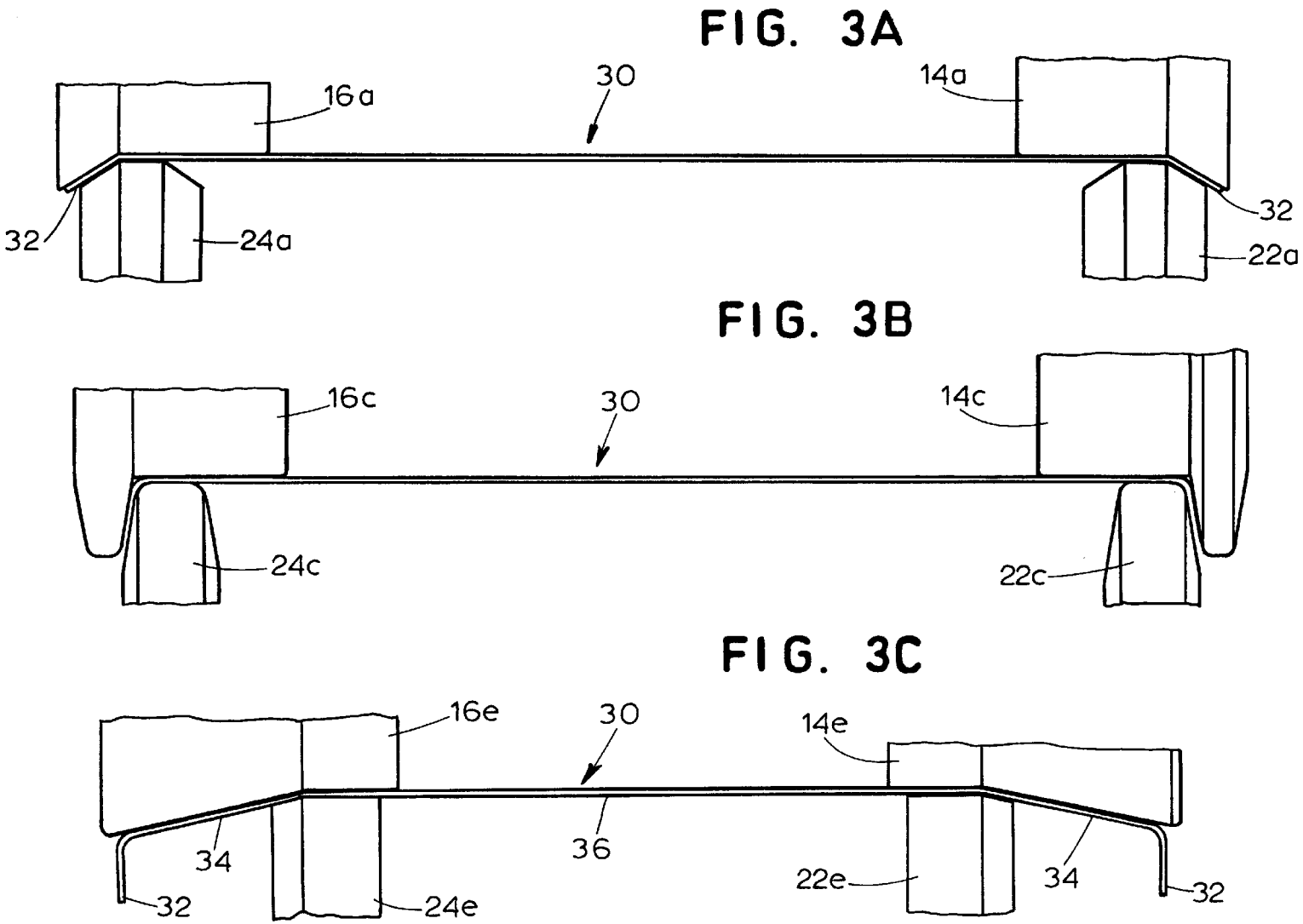
FIGS. 3A–3F illustrate portions of a number of roll-forming stations used to form C-shaped components.

The metal sheet enters the roll-forming station 12*a* first and passes between a pair of upper forming rolls 14*a*, 16*a* (see FIG. 3A) supported by a spindle 18a rotatably journalled in a pair of frame members 20*a* and a pair of lower forming rolls 22*a*, 24*a* (see FIG. 3A) supported by a spindle 26*a* rotatably journalled in the frame members 20*a*. The transverse shape of the forming rolls 14*a*, 16*a*, 22*a*, 24*a* is illustrated in FIG. 3A, which shows a pair of initial bends being formed in a metal sheet 30 to form a pair of flanges 32 at the transverse ends of the sheet 30.

After passing through the roll-forming station 12*b*, the sheet enters the roll-forming station 12*c*, where the two bends made to form the flanges 32 are increased. In the station 12*c*, the sheet passes between a pair of upper forming rolls 14*c*, 16*c* (see FIG. 3B) supported by a spindle 18*c* rotatably journalled in a pair of frame members 20*c* and a pair of lower forming rolls 22*c*, 24*c* (see FIG. 3B) supported by a spindle 26*c* rotatably journalled in the frame members 20*c*.

After passing through the roll-forming station 12*d*, the sheet enters the roll-forming station 12*e*, where two new bends are started to form a pair of legs 34 and a center portion 36 of the sheet or component 30. In the station 12*e*, the sheet passes between a pair of upper forming rolls 14*e*, 16*e* (see FIG. 3C) supported by a spindle 18e rotatably journalled in a pair of frame members 20*e* and a pair of lower forming rolls 22*e*, 24*e* (see FIG. 3C) supported by a spindle 26*e* rotatably journalled in the frame members 20*e*. Stations 12*f* (and any stations disposed between station 12*e* and 12*f*) are used to increase the bends that separate the leg portions 34 of the component 30 from its center portion 36.

At station 12*g*, the component 30 passes between a pair of upper forming rolls 14*g*, 16*g* (see FIG. 3D) supported by a spindle 18*g* rotatably journalled in a pair of frame members 20*g* and a pair of lower forming rolls 22*g*, 24*g* (see FIG. 3D) supported by a spindle 26*g* rotatably journalled in the frame members 20*g*. Station 12*g* also includes a third pair of annular forming rolls 40*g*, 42*g* that have a central hollow portion through which the lower spindle 26*g* passes. The annular forming rolls 40*g*, 42*g* have a pair of cylindrical surfaces 44*g*, 46*g*, each of which makes flush contact with a respective flange 32 of the component 30.

As described below, each of the annular forming rolls 40*g*, 42*g* is supported by a respective cradle mechanism, one of which is shown in FIG. 1A to include three support rollers 50*g*. The vertical position of the cradle mechanism, and thus of the annular forming rolls 40*g*, 42*g* is adjustable so that the cylindrical surfaces 44*g*, 46*g* may always make flush contact with the flanges 32 of the component 30 being formed, regardless of the length of the legs 34 of the component 30.

At station 12*h*, the component passes between a pair of upper forming rolls 14*h*, 16*h* (see FIG. 3E) supported by a spindle 18*h* rotatably journalled in a pair of frame members 20*h* and a pair of lower forming rolls 22*h*, 24*h* (see FIG. 3E) supported by a spindle 26*h* rotatably journalled in the frame members 20*h*. Station 12*h* includes a pair of annular forming rolls 40*h*, 42*h* having a central hollow portion through which the lower spindle 26*h* passes. The annular forming rolls 40*h*, 42*h* have a pair of cylindrical surfaces 44*h*, 46*h*, each of which makes flush contact with a respective flange 32 of the component 30. Each of the annular forming rolls 40*h*, 42*h* is supported by a respective cradle mechanism, one of which is shown in FIG. 1A to include three support rollers 50*h*.

At station 12*i*, the component passes between a pair of upper forming rolls 14*i*, 16*i* (see FIG. 3F) supported by a spindle 18*i* rotatably journalled in a pair of frame members 20*i* and a pair of lower forming rolls 22*i*, 24*i* (see FIG. 3F) supported by a spindle 26*i* rotatably journalled in the frame members 20*i*. Station 12*i* includes a pair of annular forming rolls 40*i*, 42*i* each having a central hollow portion through which the lower spindle 26*i* passes. The annular forming rolls 40*i*, 42*i* have a pair of cylindrical surfaces 44*i*, 46*i*, each of which makes flush contact with a respective flange 32 of the component 30. Each of the annular forming rolls 40*i*, 42*i* is supported by a respective cradle mechanism, one of which is shown in FIG. 1A to include a lower support roller 52*i* and a pair of side support members 54*i*.

The final station 12*j* may be used to apply an additional driving force to force the component 30 out of the roll-forming machine 10, and not to make any additional bends in the component 30.

FIG. 1B illustrates a second portion of the roll-forming machine 10 which forms a component 56 having a Z-shaped cross section from a flat sheet of metal. As shown in FIGS. 4C–4E, the component 56 has a center portion 57, a pair of leg portions 58 joined to the center portion 57, and a pair of flanges 59 joined to the leg portions 58.

Referring to FIG. 1B and FIGS. 4A through 4E, the Z-shaped component 56 is formed by successively feeding the metal sheet through a plurality of roll-forming stations 60*a* through 60*i*.

The roll-forming stations 60 include a plurality of upper forming rolls 64*a*–64*i*, 66*a*–66*i* supported by a plurality of upper spindles 68*a*–68*i* rotatably journalled in a plurality of frame members 70*a*–70*i* and a plurality of lower forming rolls 72*a*–72*i*, 74*a*–74*i* supported by a plurality of lower spindles 76*a*–76*i* rotatably journalled in the frame members 70*a*–70*i*. The final station 60*j* may be used to apply an additional driving force to force the component 56 out of the roll-forming machine 10, and not to make any additional bends in the component 56.

As schematically shown in FIGS. 4D and 4E, the roll-forming stations 60*h* and 60*i* include a plurality of rollers 80*h*, 80*i*, 82*h*, 82*i* which make rolling contact with the Z-shaped component 56 at the intersections of the center and leg portions 57, 58 of the component 56. The purpose of the rollers 80*h*, 80*i*, 82*h*, 82*i* is to enable the formation of sharp bends at those intersections.

The rollers 80*h*, 80*i*, 82*h*, 82*i* are supported by a support structure shown schematically in FIG. 1B. Referring to FIG. 1B, that support structure includes a horizontal support bar 84 mounted to the two outer or "outboard" frame members 70*h*, 70*i*, a horizontal support bar 86 mounted to the two inner or "inboard" frame members 70*h*, 70*i*, three upper adjustment mechanisms 88 fixed to the support bar 84 for pivotally adjusting the position of the rollers 80*h*, 80*i*, and three lower adjustment mechanisms 90 fixed to the support bar 86 for pivotally adjusting the position of the rollers 82*h*, 82*i*.

Figure 2:
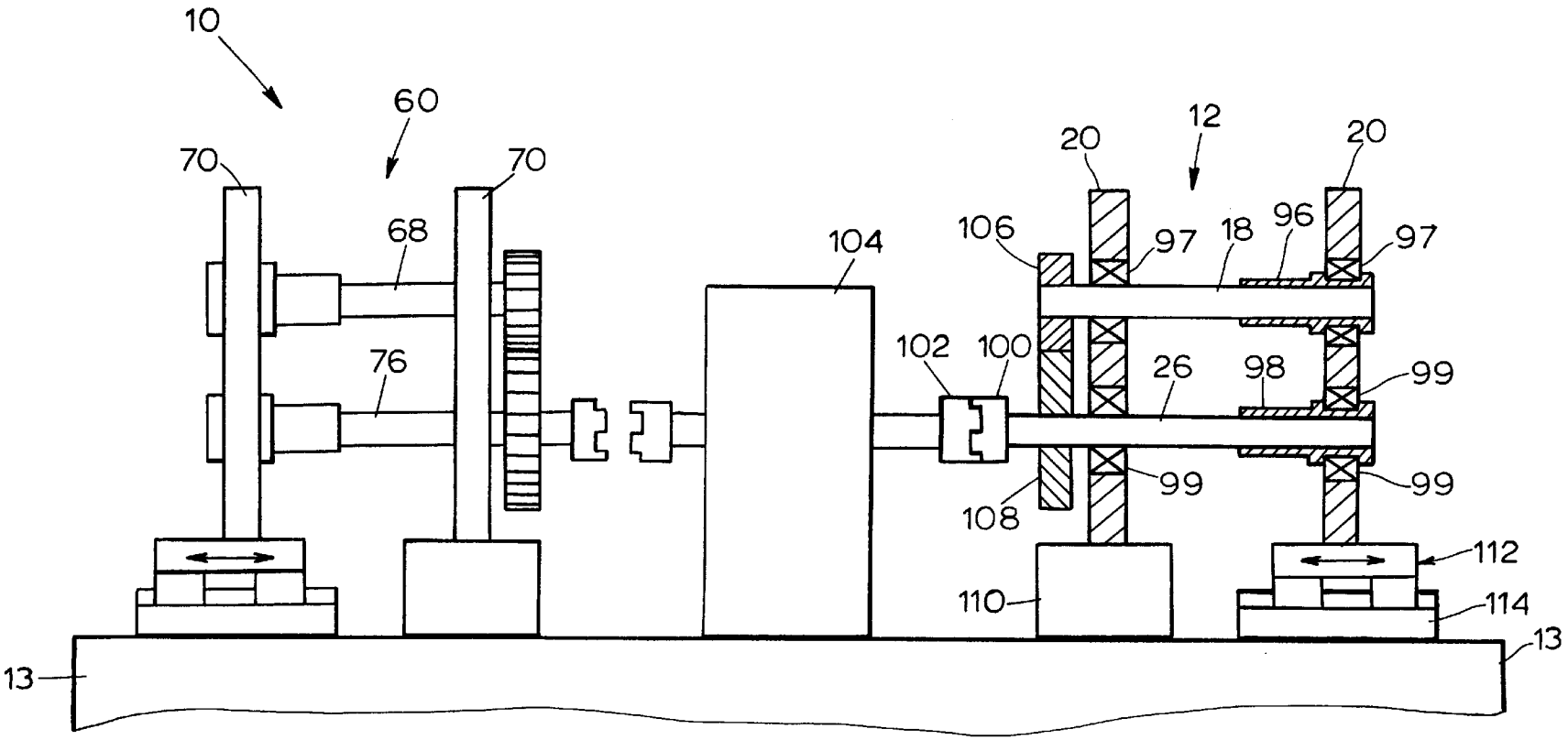
FIG. 2 is a schematic end view of the roll-forming machine of FIGS. 1A and 1B.

FIG. 2 is a view of the roll-forming machine 10 (the forming rolls and other components not being shown) showing the construction of two roll-forming stations 12, 60. Referring to the right-hand portion of FIG. 2, a sleeve 96 is disposed around the right-hand portion of the upper spindle 18, and a sleeve 98 is disposed around the right-hand portion of the lower spindle 26. Each of the sleeves 96, 98 has a keyed portion (not shown) which extends into a respective slot (not shown) formed in each of the spindles 18, 26 so that the upper spindle 18 and the sleeve 96 are forced to rotate together within bearings 97 (schematically shown) and so that the lower spindle 26 and the sleeve 98 are forced to rotate together within bearings 99 (schematically shown).

One of the upper forming rolls 16 (not shown in FIG. 2) is mounted to the left-hand side of the spindle 18 between the frame members 20, and the other upper forming roll 14 (not shown in FIG. 2) is mounted to the sleeve 96. Two lower forming rolls 22, 24 (not shown in FIG. 2) are similarly mounted to the lower spindle 26 and sleeve 98. The lower spindle 26 has a coupler 100 attached to its left end which mates with a horizontally movable coupler 102 that may be rotatably driven by a drive mechanism 104. The upper spindle 18 is rotatably driven via an upper gear 106 fixed to the upper spindle 18 and a lower gear 108 fixed to the lower spindle 26. As is well known, not all of the spindles of roll-forming stations need to be rotatably driven by the drive mechanism 104.

Referring to the right-hand side of FIG. 2, the inboard (left) frame member 20 is supported by a block 110 fixed to the machine base 13, and the outboard frame member 20 is supported by a base 112 slidably supported by a slide fixture 114 mounted on the machine base 13. By horizontally sliding the outboard frame member 20, the horizontal distance between the forming rolls mounted to the spindles 18, 26 and sleeves 96, 98 can be varied (to vary the transverse lengths of the center portion and leg portions of a component to be formed) since the sleeves 96, 98 slide horizontally along the spindles 18, 26 in response to movement of the outboard frame member 20.

The construction of the roll-forming stations 60 used to form Z-shaped components, shown in the left-hand side of FIG. 2, is substantially the same as the construction just described. The particular construction of the roll-forming stations 12, 60, which could take many forms in accordance with the invention, could be in accordance with allowed U.S. application No. 08/323,139, now U.S. Pat. No. 5,644,942, entitled "Roll Stand Raft Assembly," the disclosure of which is incorporated herein by reference.

FIGS. 5 through 8 illustrate the manner in which one of the annular forming rolls 42*g* is adjustably supported. Referring to FIG. 5, the annular forming roll 42*g* is supported by the three support rollers 50*g* shown schematically in FIG. 1A. Each of the support rollers 50*g* is mounted to an upper metal plate 120 by a respective bolt 122. The support rollers 50*g* include internal bearings (not shown) which allow them to freely rotate.

The plate 120 is pivotally connected to a mounting member 124 via a pivot member 126 connected to the plate 120 which passes through a cylindrical bore formed in the mounting member 124, the pivot member 126 being pivotally secured within the bore in the mounting member 124 via a collar 128. The mounting member 124 is fixed to the machine base 13 via a plurality of bolts 130.

The upper plate 120 has a U-shaped opening 132 formed therein to facilitate the passage of the spindle 26*g* and a sleeve 98*g* disposed around the spindle 26*g*. The upper plate 120 is connected to a lower plate 134, at an angle to the lower plate 134, via a pair of brackets 136 welded to both of the plates 120, 134. The lower plate 134 has a U-shaped opening 138 formed therein to accommodate the lowermost roller 50*g* (see FIG. 5).

A wheel support bracket 140 is connected to the bottom end of the lower plate 134 via a plurality of bolts 142. The bracket 140 has a roller 144 rotatably mounted to it via a nut and bolt assembly 146. As shown in FIG. 5, the roller 144 rests on a horizontal plate 150 that may be moved up and down within an enclosure formed by a number of walls 152.

Figure 3D:
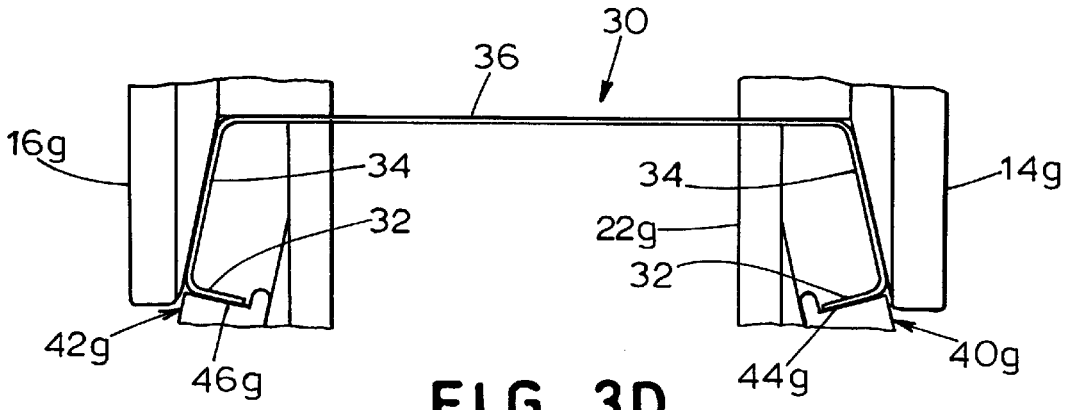

By moving the plate 150 up or down, the position of the annular forming roll 42*g* may be adjusted up or down so that its edge surface 46*g* may make flush contact with the flanges 32 of the component 30, as shown in FIG. 3D, regardless of the length of the legs 34 of the component 30. Referring to FIG. 5, when the plate 150 is forced upwards, the roller 144 and the plates 120, 134 to which it is connected are forced upwards in an arc, due to the upper plate 120 being pivotably connected to the stationary mounting fixture 124. Upward movement of the plate 120 causes upward movement of the rollers 50*g* which support or cradle the annular forming roll 42*g*, thus forcing the annular forming roll 42*g* upwards (for the case where the component 30 has relatively short legs 34). The upward and downward movement of the annular forming roll 42*g* is limited by the diameter of its central circular opening 154 through which the spindle 26*g* and sleeve 98*g* pass.

Figure 3E:
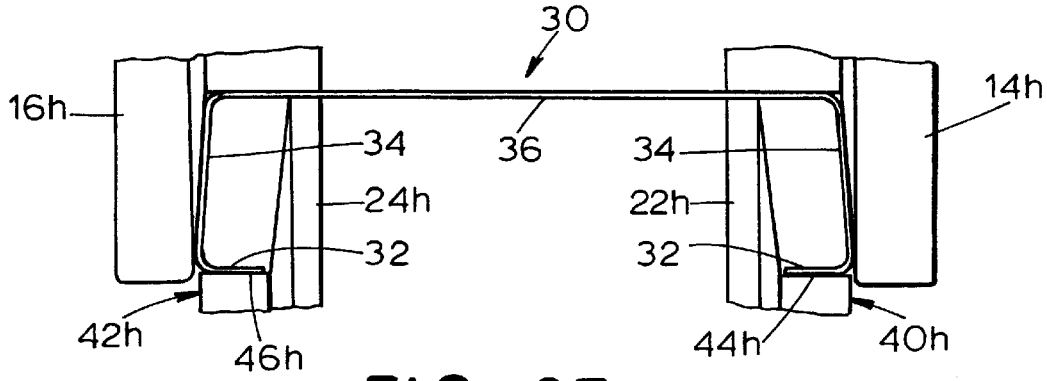
Figure 3F:
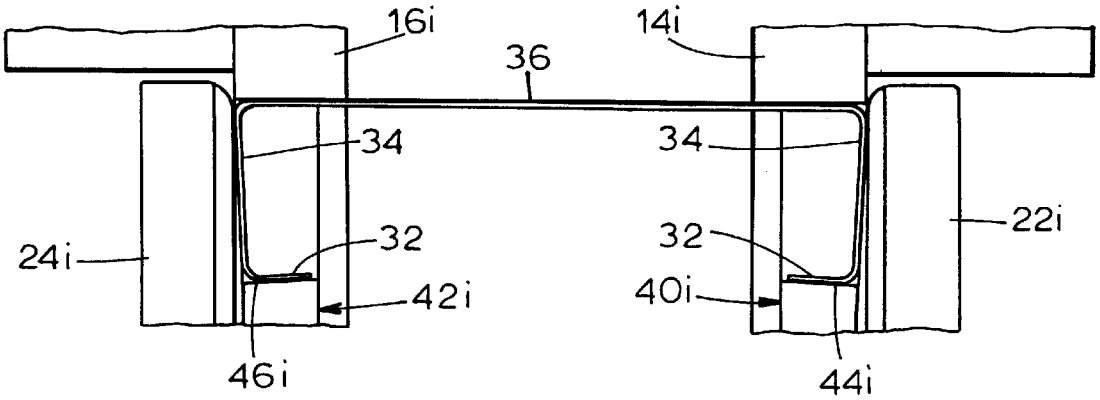

The structure for adjustably supporting the annular forming roll 40*g* shown in FIG. 3D is the same as that shown in FIGS. 5 through 8, except that components 124 and 136 are modified so that the forming roll 40*g* is supported at an angle symmetric to that of the forming roll 42*g*, as shown in FIG. 3D. The structure for adjustably supporting the annular forming rolls 40*h* and 42*h* shown in FIG. 3E is substantially the same as that shown in FIGS. 5 through 8, except that the component 124 is modified (by making its upper portion vertical instead of angled) and the components 136 eliminated (the lower plate 134 being welded directly to the upper plate 120) so that the forming rolls 40*h* and 42*h* are supported in a substantially vertical position, as shown in FIG. 3E.

FIG. 9 illustrates the structure for adjustably supporting the annular forming roll 40*i* of roll-forming station 12*i*. Referring to 9, that structure is similar to that shown in FIG. 5, except that the relatively large roller 52*i* shown schematically in FIG. 1 is used to support the bottom of the annular forming roll 40*i*, and the sides of the forming roll 42*i* are maintained in place by side support members 54*i*, which make sliding contact with the forming roll 40*i*. The bottom roller 52*i* is rotatably supported between a pair of plates 160 which are pivotally connected to a mounting fixture 162 as described above in connection with FIG. 5. Each of the side support members 54*i* is mounted to a respective mounting plate 164, each of which has a lower end connected between the plates 160. A positioning roller 166 may be used to aid in the positioning of the component 30 before it arrives at the roll-forming station 12*i*.

Figure 10:
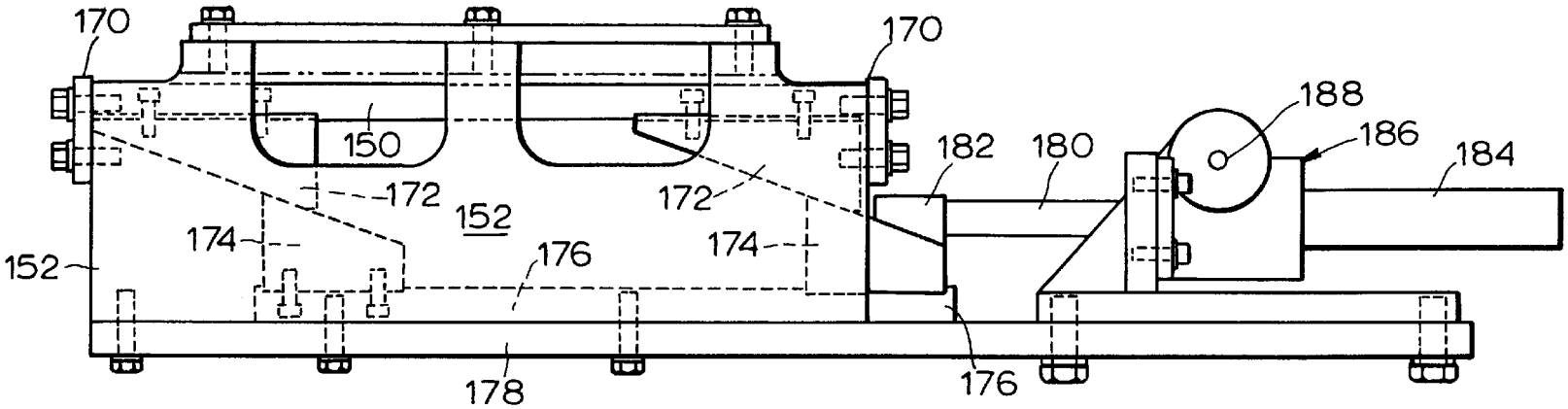
FIGS. 10–12 illustrate structure for adjusting the position of three vertically movable plates which supports the adjustment mechanisms shown in FIGS. 5–9.
Figure 12:
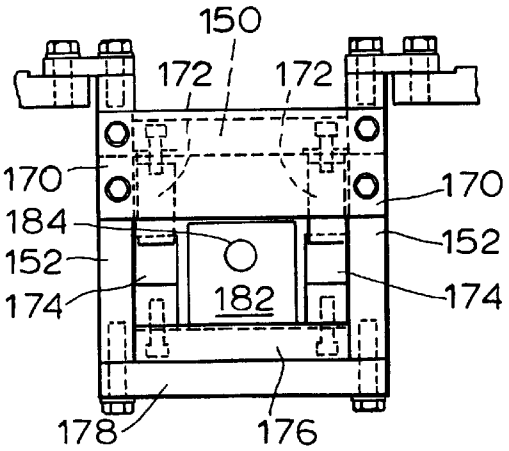
Figure 11:
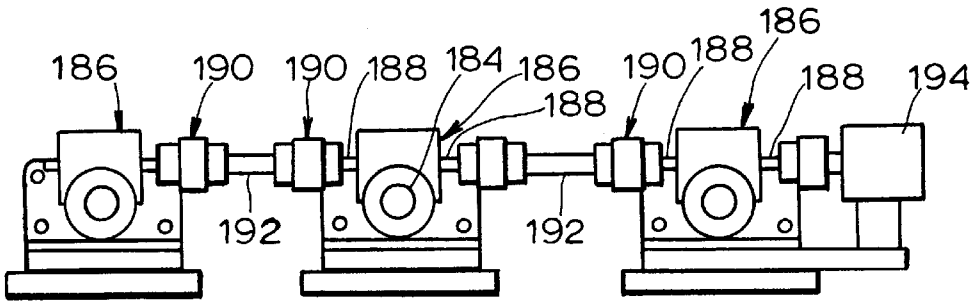

FIGS. 10–12 illustrate one manner of raising and lowering the plate 150 on which the rollers (e.g. roller 144 shown in FIG. 5) of the annular forming roll support mechanisms rest. Referring to FIG. 10, the plate 150 is snugly supported for vertical movement within an enclosure formed by the walls 152 and two additional walls 170. Four angled members 172 are bolted to the underside of the plate 150, and four similarly angled members 174 are bolted to the upper side of a horizontally shiftable plate 176, which rests on a base plate 178 to which the walls 152 are bolted.

A horizontally translatable rod 180 is connected to the shift plate 176 via a bracket 182 fixed to the upper side of the shift plate 176. For example, the end of the rod 180 may be threaded into a bore 184 (FIG. 12) formed in the bracket 182. The rod 180 may be horizontally translated into and out of a cylinder 184 under the control of a drive mechanism 186, such as a screw jack drive. The drive mechanism 186 may include a pair of coupling rods 188 disposed in a direction transverse to the rod 180, to facilitate interconnection of a plurality of the structures shown in FIG. 10, such as the assembly shown in FIG. 11.

FIG. 11 illustrates the interconnection of three drive mechanisms 186 via a plurality of couplers 190 and drive shafts 192, the right-most coupler 190 being connected to the drive shaft of a motor 194. With the construction shown in FIG. 11, the vertical position of the annular forming rolls 40*g*, 40*h*, 40*i* of the roll-forming stations 12*g*, 12*h*, 12*i* may be simultaneously adjusted via the motor 194.

In the operation of the roll-forming machine 10 described above, a sheet of material may be fed to a plurality of roll-forming stations to cause the flanges 32 and legs 34 of a C-shaped component 30 to be formed, the C-shaped component having a first leg length. After the formation of a number of such components, the roll-forming machine 10 can be reconfigured in a simplified manner to produce C-shaped components having different leg lengths.

This reconfiguration is accomplished by shifting the outboard frame members 20 in a horizontal direction, as described above in connection with FIG. 2, and then adjusting the vertical position of the three annular forming rolls 40*g*, 40*h*, 40*i*, as described above in connection with FIGS. 5 and 9–11. After such adjustments are made, C-shaped components having different leg lengths than the original C-shaped components can be formed.

Figure 13B:
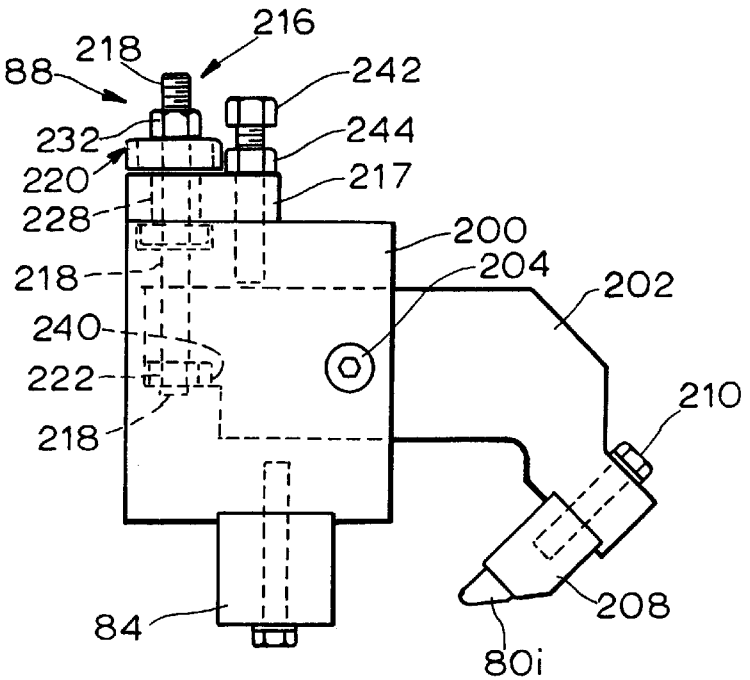
Figure 13A:
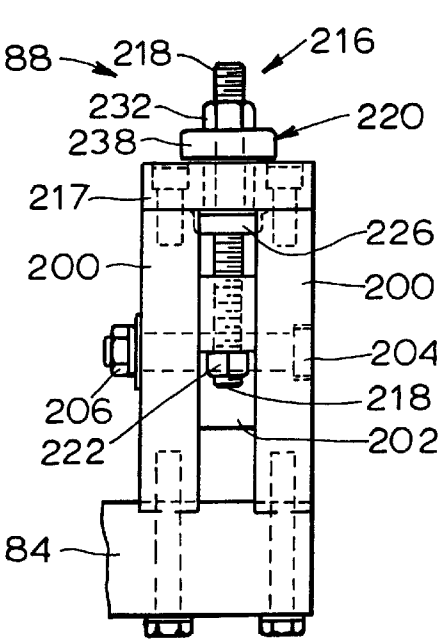
Figure 14:
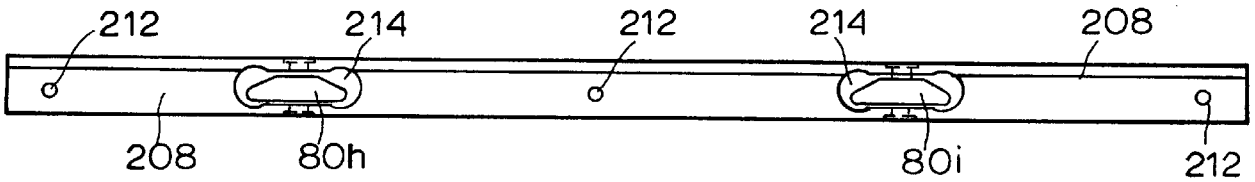

FIGS. 13A and 13B illustrate the structure of one of the upper adjustment mechanisms 88 shown schematically in FIG. 1B. Referring to FIGS. 13A and 13B, each adjustment mechanism 88 includes a pair of spaced-apart side plates 200 bolted to the top of the support bar 84 (shown schematically in FIG. 1B). A pivot arm 202 is pivotably disposed between the side plates 200 via a bolt 204 and a nut 206 threaded onto the bolt 204. The lower end of each pivot arm 202 is connected to a mounting bar 208 via a plurality of bolts 210 which are threaded into a plurality of holes 212 (see FIG. 14) formed in the mounting bar 208. As shown in FIG. 14, the rollers 80*h*, 80*i* (one of which is shown schematically in FIG. 4D and one of which is shown schematically in FIG. 4E) are rotatably supported by the mounting bar 208 within a respective elongate slot 214 formed in the mounting bar 208. The position of the rollers 80*h*, 80*i* relative to the forming rolls 66*h*, 72*h*, respectively, is adjustable so that different gap distances may be provided between those components 80*h*, 80*i*, 66*h*, 72*h* to accommodate the formation of Z-shaped components 56 having different thicknesses.

The angular position of the pivot arm 202, and thus of the rollers 80*h*, 80*i* is adjustable via an adjustment mechanism 216 connected to an upper plate 217 bolted to the top of the side plates 200. The adjustment mechanism 216 includes a headless screw 218, an adjustable collar assembly 220, and a nut 222 welded to the bottom end of the screw 218.

Figure 15:
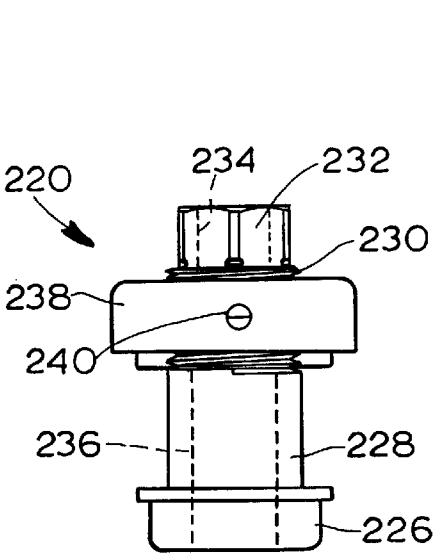
FIGS. 13A–15 illustrate a first structure for pivotably supporting a plurality of contact rollers.

The structure of the adjustable collar assembly 220 is shown in FIG. 15. Referring to FIG. 15, the collar assembly 220 has a first component 224 having a cylindrical head 226, a cylindrical body portion 228, a threaded portion 230, and a nut portion 232, all of which are formed from a single piece of metal. The nut portion 232 has an internal threaded bore 234 formed therein, and the head and body portion 226, 228 have a smooth internal bore 236 formed therein coaxially with the threaded bore 234.

The collar assembly 220 has a second component in the form of an annular collar 238 that is threaded onto the threaded portion 230. One or more set screws 240 may be provided in the collar 238 to prevent the collar 238 from turning on the threaded portion 230 of the component 224.

Referring also to FIGS. 13A and 13B, the collar assembly 220 is installed on the top plate 217 by rotatably adjusting the position of the collar 238 until the space between the collar 238 and the head 226 is just sufficient to allow rotation of the collar assembly 220, and then the set screw(s) 240 in the collar 238 are tightened. Consequently, with the headless screw 218 passing through the threaded portion 234 of the nut 232, rotation of the nut 232 will cause the entire collar assembly 220 to rotate, which will cause vertical displacement of the screw 218 and the nut 222 welded to its bottom end. Neither the screw 218 or the nut 222 rotates since the nut 222 is provided within a narrow slot 240, formed in a lower surface of the pivot arm 202, which is just wide enough to accommodate the nut 222.

A bolt 242 is disposed through a threaded bore in the top plate 217 and has a lower end which abuts an upper surface of the pivot arm 202. A lock nut 244 is threaded onto the bolt 242 to lock its position. After the mechanism 216 has been adjusted to correspond to the desired position of the pivot arm 202 and the rollers 80*h*, 80*i*, the bolt 242 is rotated to move it in a downward direction until the lower end of the bolt 242 forces the left-hand end of the pivot arm 202 downwards so that it firmly abuts the nut 222 welded to the screw 218.

Figure 16B:
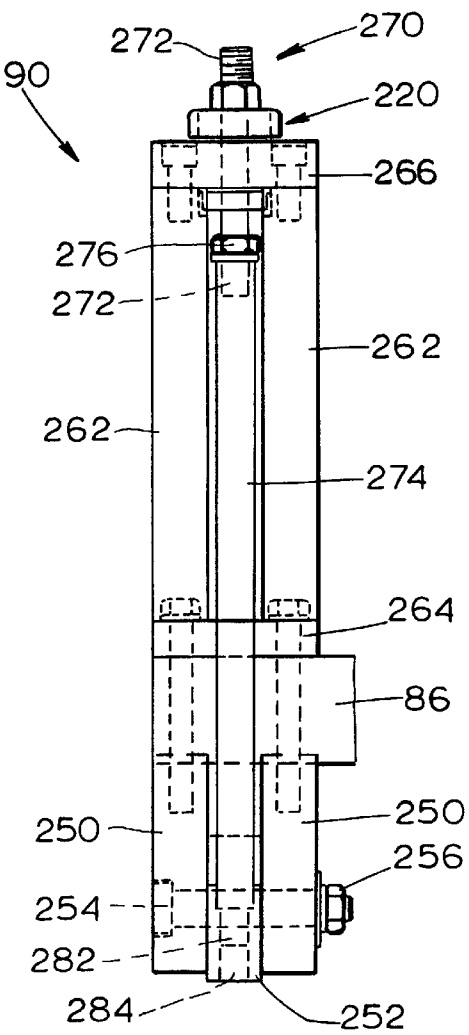
FIGS. 16A–16B illustrate a second structure for pivotably supporting a plurality of contact rollers.
Figure 16A:
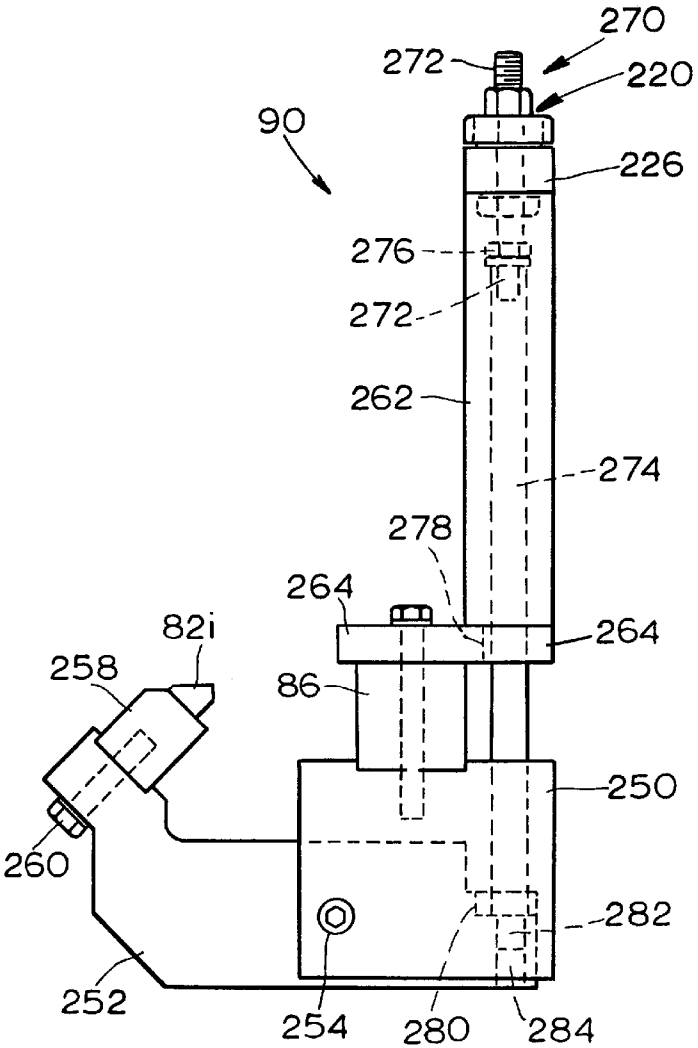

FIGS. 16A and 16B illustrate the construction of the lower adjustment mechanisms 90 (schematically shown in FIG. 1B) which are used to adjustably support the rollers 82*h*, 82*i* schematically shown FIGS. 4D and 4E. Referring to FIGS. 16A and 16B, each adjustment mechanism 90 has a pair of lower side plates 250 bolted to the bottom of the support bar 86 (shown schematically in FIG. 1B). A pivot arm 252 is pivotably disposed between the lower side plates 250 via a bolt 254 and a nut 256 threaded onto the bolt 254. The lower end of each pivot arm 252 is connected to a mounting bar 258 (which is substantially the same as the mounting bar 208 shown in FIG. 14), via a plurality of bolts 260.

A pair of upper side plates 262 are connected to a horizontally disposed plate 264 bolted to the top of the support bar 86. A top plate 266 is bolted to the upper side plates 262. An adjustment mechanism 270 substantially the same as the adjustment mechanism 216 described above in connection with FIGS. 13A, 13B and 15 is connected to the top plate 266. The adjustment mechanism 270 includes the collar assembly 220 described above. A headless screw 272 is threaded through the collar assembly 220 into the top of an elongate rod 274 having a square cross section and is secured to the rod 274 by a locking nut 276. The elongate rod 274 passes through a rectangular slot 278 (FIG. 16A) formed in the plate 264 that prevents the rod 274 from rotating. The bottom portion of the rod 274 is disposed in a similar rectangular slot 280 (FIG. 16A) formed in an upper surface of the pivot member 252, and the bottom end of the rod 274 is provided with a cylindrical member 282 which is disposed within a cylindrical bore 284 in the pivot member 252.

The adjustment of the angular position of the pivot arms 252 and the rollers 82*h*, 82*i* is performed by rotating the collar assembly 220 in the same manner as described above in connection with FIGS. 13A and 13B. No locking assembly is necessary to lock the position of the pivot arms 252 since the weight of the left-hand ends of the pivot arms 252 and the support bar 258 forces the right-hand end of the pivot arms 252 upwards against the bottom end of the square portion of the elongate rod 274.

It should be noted that, in addition to being pivotably adjustable, the position of the rollers 80 relative to the rollers 82 is also horizontally adjustable in a linear direction since the frame members 70 to which the adjustment mechanisms 88 are mounted are laterally movable, as described above in connection with FIG. 2.

Although the roll-forming machine 10 described above forms the flanges of the Z- and C-shaped components before forming the legs of those components, the machine 10 could be modified so that the legs of the Z- and/or C-shaped components are formed before the flanges.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A roll-forming apparatus, comprising:

a base structure;

a plurality of roll-forming stations associated with said base structure and adapted to form a first component having a Z-shaped cross section, said first component having a center portion and a pair of legs connected to said center portion; and a plurality of roll-forming stations associated with said base structure and adapted to form a second component and a third component, each of said second and third components having a C-shaped cross section with a center portion, a pair of legs connected to said center portion, and a pair of flanges connected to said legs, said legs of said second component having a first length and said legs of said third component having a second length different than said first length, said roll-forming stations adapted to form said second and third components comprising:

a first roll-forming station adapted to form said flanges of one of said second and third components;

a second roll-forming station adapted to form said legs of said second and third components, said second roll-forming station comprising:

a first pair of forming rolls;

a second pair of forming rolls; and a support structure including a spindle and being adapted to adjustably support said forming rolls of said first and second pairs so that the distance between said forming rolls of said first pair and said forming rolls of said second pair can be varied; and a third roll-forming station adapted to form said legs of said second and third components, said third roll-forming station comprising:

a first pair of forming rolls;

a second pair of forming rolls; and a support structure including a spindle and being adapted to adjustably support said forming rolls of said first and second pairs of said third roll-forming station so that the position of said second pair of forming rolls of said third roll-forming station is adjustable relative to said first pair of forming rolls of said third roll-forming station through a range of positions including a first position in which said second pair of forming rolls of said third roll-forming station would abut said flanges of said second component and a second position in which said second pair of forming rolls of said third roll-forming station would abut said flanges of said third component.

2. An apparatus as defined in claim 1, wherein each of said forming rolls of said second pair of said third roll-forming station has a cylindrical surface, wherein each of said cylindrical surfaces is substantially flush with a respective one of said flanges of said second component when said forming rolls of said second pair of said third roll-forming station are in said first position, and wherein each of said cylindrical surfaces is substantially flush with a respective one of said flanges of said third component when said forming rolls of said second pair of said third roll-forming station are in said second position.

3. An apparatus as defined in claim 1, wherein said second roll-forming station is adapted to form said legs of one of said second and third components by making a pair of initial bends at a pair of points in one of said second and third components, and wherein said third roll-forming station is adapted to form said legs of one of said second and third components by further bending said one component at said points at which said initial bends were made by said second roll-forming station.

4. An apparatus as defined in claim 1, wherein said support structure of said third roll-forming station comprises a first spindle and a second spindle, wherein each of said forming rolls of said second pair of said third roll-forming station has a central aperture through which said second spindle passes, and wherein said support structure of said third roll-forming station comprises an adjustment mechanism adapted to adjust the position of said forming rolls of said second pair of said third roll-forming station relative to said second spindle.

5. An apparatus as defined in claim 4 wherein said adjustment mechanism comprises:

a cradle mechanism adapted to support one of said forming rolls of said second pair of said third roll-forming station, said cradle mechanism being mechanically uncoupled to said one forming roll; and a support structure adapted to adjust the position of said cradle mechanism.

6. A roll-forming apparatus, comprising:

a base structure;

a plurality of roll-forming stations associated with said base structure and adapted to form a first component having a Z-shaped cross section, said first component having a center portion and a pair of legs connected to said center portion; and a plurality of roll-forming stations associated with said base structure and adapted to form a second component and a third component, each of said second and third components having a C-shaped cross section with a center portion, a pair of legs connected to said center portion, and a pair of flanges connected to said legs, said legs of said second component having a first length and said legs of said third component having a second length different than said first length, said roll-forming stations adapted to form said second and third components comprising:

a first roll-forming station adapted to form said flanges of one of said second and third components;

a second roll-forming station adapted to form said legs of said second and third components, said second roll-forming station comprising:

a first pair of forming rolls;

a second pair of forming rolls; and a support structure including a spindle and being adapted to adjustably support said forming rolls of said first and second pairs so that the distance between said forming rolls of said first pair and said forming rolls of said second pair can be varied; and a third roll-forming station adapted to form said legs of said second and third components, said third roll-forming station comprising:

a first pair of forming rolls;

a second pair of forming rolls; and a support structure including a spindle and being adapted to adjustably support said forming rolls of said first and second pairs of said third roll-forming station so that the position of said second pair of forming rolls of said third roll-forming station is adjustable from a first position in which said second pair of forming rolls of said third roll-forming station would make contact with a portion of said second component to a second position in which said second pair of forming rolls of said third roll-forming station would make contact with a portion of said third component.

7. An apparatus as defined in claim 6 wherein said second pair of forming rolls of said third roll-forming station are movable through a range of positions including a first position in which said second pair of forming rolls of said third roll-forming station are spaced from said first pair of forming rolls of said third roll-forming station by a first distance substantially corresponding to the length of said legs of said second component and a second distance substantially corresponding to the length of said legs of said third component.

8. An apparatus as defined in claim 6, wherein said support structure of said third roll-forming station comprises a first spindle and a second spindle, wherein each of said forming rolls of said second pair of said third roll-forming station has a central aperture through which said second spindle passes, and wherein said support structure of said third roll-forming station comprises an adjustment mechanism adapted to adjust the position of said forming rolls of said second pair of said third roll-forming station relative to said second spindle.

9. An apparatus as defined in claim 8 wherein said adjustment mechanism comprises:

a cradle mechanism adapted to support one of said forming rolls of said second pair of said third roll-forming station, said cradle mechanism being mechanically uncoupled to said one forming roll; and a support structure adapted to adjust the position of support said cradle mechanism.

10. A roll-forming apparatus, comprising:

a plurality of roll-forming stations adapted to form a first component and a second component, each of said first and second components having a C-shaped cross section with a center portion, a pair of legs connected to said center portion, and a pair of flanges connected to said legs, said legs of said first component having a first length and said legs of said second component having a second length different than said first length, said roll-forming stations comprising:

a first roll-forming station adapted to form said flanges of one of said first and second components;

a second roll-forming station adapted to form said legs of said first and second components, said second roll-forming station comprising:

a first pair of forming rolls;

a second pair of forming rolls; and a support structure including a spindle and being adapted to adjustably support said forming rolls of said first and second pairs so that the distance between said forming rolls of said first pair and said forming rolls of said second pair can be varied; and a third roll-forming station adapted to form said legs of said first and second components, said third roll-forming station comprising:

a first pair of forming rolls;

a second pair of forming rolls;

a third pair of forming rolls; and a support structure including a first spindle which supports said first pair of forming rolls of said third roll-forming station and a second spindle which supports said second pair of forming rolls of said third roll-forming station, said support structure being adapted to adjustably support said forming rolls of said third roll-forming station so that the position of said third pair of forming rolls is adjustable relative to said first pair of forming rolls of said third roll-forming station through a range of positions including a first position in which said third pair of forming rolls would abut said flanges of said first component and a second position in which said third pair of forming rolls would abut said flanges of said second component, said support structure being adapted to move said third pair of forming rolls relative to both of said spindles of said third roll-forming station.

11. An apparatus as defined in claim 10, wherein each of said forming rolls of said third pair of forming rolls has a central aperture through which said second spindle passes, and wherein said support structure of said third roll-forming station comprises an adjustment mechanism adapted to adjust the position of said forming rolls of said third pair of forming rolls relative to said second spindle.

12. An apparatus as defined in claim 11 wherein said adjustment mechanism comprises:

a cradle mechanism adapted to support one of said forming rolls of said third pair of forming rolls, said cradle mechanism being mechanically uncoupled to said one forming roll; and a support structure adapted to adjust the position of said cradle mechanism.

13. A roll-forming apparatus, comprising:

a plurality of roll-forming stations adapted to form a first component and a second component, each of said first and second components having a C-shaped cross section with a center portion and a pair of legs connected to said center portion, said legs of said first component having a first length and said legs of said second component having a second length different than said first length, said roll-forming stations comprising:

a first roll-forming station having a plurality of forming rolls; and a second roll-forming station adapted to form said legs of said first and second components, said second roll-forming station comprising:

a first pair of forming rolls;

a second pair of forming rolls;

a third pair of forming rolls; and a support structure including a first spindle which supports said first pair of forming rolls and a second spindle which supports said second pair of forming rolls, said support structure being adapted to adjustably support said forming rolls of said second roll-forming station so that said third pair of forming rolls is movable from a first position in which said third pair of forming rolls would make contact with a portion of said first component to a second position in which said third pair of forming rolls would make contact with a portion of said second component, said support structure being adapted to move said third pair of forming rolls relative to both of said spindles of said second roll-forming station.

14. An apparatus as defined in claim 13, wherein each of said forming rolls of said third pair has a central aperture through which said second spindle passes, and wherein said support structure comprises an adjustment mechanism adapted to adjust the position of said forming rolls of said third pair relative to said second spindle.

15. An apparatus as defined in claim 14 wherein said adjustment mechanism comprises:

a cradle mechanism adapted to support one of said forming rolls of said third pair, said cradle mechanism being mechanically uncoupled to said one forming roll; and a support structure adapted to adjust the position of said cradle mechanism.

16. A roll-forming apparatus, comprising:

a plurality of roll-forming stations adapted to form a first component and a second component, each of said first and second components having a C-shaped cross section with a center portion and a pair of legs connected to said center portion, said legs of said first component having a first length and said legs of said second component having a second length different than said first length, said roll-forming stations comprising:

a first roll-forming station having a plurality of forming rolls; and a second roll-forming station adapted to form said legs of said first and second components, said second roll-forming station comprising:

a spindle;

a pair of forming rolls associated with said spindle; and a support structure adapted to support said forming rolls, said support structure being adapted to adjustably support said forming rolls of said second roll-forming station so that said forming rolls of said second roll-forming station are movable relative to said spindle from a first position in which said forming rolls of said second roll-forming station would make contact with a portion of said first component to a second position in which said forming rolls of said second roll-forming station would make contact with a portion of said second component.

17. An apparatus as defined in claim 16, wherein each of said forming rolls of said third pair has a central aperture through which said second spindle passes, and wherein said support structure comprises an adjustment mechanism adapted to adjust the position of said forming rolls of said third pair relative to said second spindle.

18. A roll-forming apparatus, comprising:

a plurality of roll-forming stations adapted to form a first component and a second component, each of said first and second components having a C-shaped cross section with a center portion and a pair of legs connected to said center portion, said legs of said first component having a first length and said legs of said second component having a second length different than said first length, said roll-forming stations comprising:

a first roll-forming station having a plurality of forming rolls; and a second roll-forming station adapted to form said legs of said first and second components, said second roll-forming station comprising:

a spindle;

a pair of forming rolls, each of said forming rolls having a central aperture through which said spindle passes; and a support structure adapted to adjust the position of said forming rolls relative to said spindle.

19. A method of forming components including a first component and a second component, each of said first and second components having a C-shaped cross section with a center portion, a pair of legs connected to said center portion, and a pair of flanges connected to said legs, said legs of said first component having a first length and said legs of said second component having a second length different than said first length, said method comprising the steps of:

(a) feeding a sheet of material to a first roll-forming station for causing said flanges of said first component to be formed;

(b) feeding said sheet of material to a second roll-forming station for causing said legs of said first component to be formed;

(c) feeding said sheet of material to a third roll-forming station having a first pair of forming rolls supported by a first spindle, a second pair of forming rolls supported by a second spindle, and a third pair of forming rolls so that said forming rolls make contact with said first sheet;

(d) adjusting the position of said third pair of forming rolls to vary the distance between said third pair of forming rolls and both of said spindles;

(e) feeding a second sheet of material to said first roll-forming station for causing said flanges of said second component to be formed;

(f) feeding said second sheet of material to said second roll-forming station for causing said legs of said second component to be formed; and (g) feeding said second sheet of material to said third roll-forming station so that said forming rolls make contact with said second sheet.

20. A method as defined in claim 19 wherein said step (d) comprises the step of adjusting the position of said third pair of forming rolls relative to said first pair of forming rolls between a first position in which said third pair of forming rolls would abut said flanges of said first component and a second position in which said third pair of forming rolls would abut said flanges of said second component.

21. A method of forming components including a first component and a second component, each of said first and second components having a C-shaped cross section with a center portion, a pair of legs connected to said center portion, and a pair of flanges connected to said legs, said legs of said first component having a first length and said legs of said second component having a second length different than said first length, said method comprising the steps of:

(a) feeding a sheet of material to a first roll-forming station for causing said flanges of said first component to be formed;

(b) feeding said sheet of material to a second roll-forming station for causing said legs of said first component to be formed;

(c) feeding said sheet of material to a third roll-forming station having a plurality of forming rolls supported by a plurality of spindles so that said forming rolls make contact with said first sheet;

(d) adjusting the position of at least one of said forming rolls without moving the position of any of said spindles;

(e) feeding a second sheet of material to said first roll-forming station for causing said flanges of said second component to be formed;

(f) feeding said second sheet of material to said second roll-forming station for causing said legs of said second component to be formed; and (g) feeding said second sheet of material to said third roll-forming station so that said forming rolls make contact with said second sheet.

22. A roll-forming apparatus, comprising:

a base structure; and a plurality of roll-forming stations associated with said base structure and adapted to form components having a Z-shaped cross section, said components each having a center portion, a pair of legs connected to said center portion, and a pair of flanges connected to said legs, said roll-forming stations adapted to form said components comprising:

a first roll-forming station adapted to form said flanges of said components;

a second roll-forming station adapted to form said legs of said components, said second roll-forming station comprising:

a first pair of forming rolls;

a second pair of forming rolls; and a support structure including a spindle and adapted to adjustably support said forming rolls of said first and second pairs so that the distance between said forming rolls of said first pair and said forming rolls of said second pair is variable so that the lengths of said legs of said components may be varied; and a third roll-forming station adapted to form said legs of said components, said third roll-forming station comprising:

a pair of forming rolls;

a forming-roll support adapted to support said forming rolls of said third roll-forming station; and a contact roller being disposed to make contact with one of said components at the junction of one of said legs of said one component and said center portion of said one component, said contact roller being pivotable about a pivot axis and adjustable in a substantially linear direction.

23. An apparatus as defined in claim 22 additionally comprising a plurality of roll-forming stations associated with said base structure and adapted to form components each having a C-shaped cross section with a center portion and a pair of legs connected to said center portion.

24. An apparatus as defined in claim 22 additionally comprising a second contact roller for making contact with said one component at the junction of a second of said legs of said one component and said center portion of said one component, said second contact roller being pivotable about a pivot axis and adjustable in a substantially linear direction.

* * * * *